US006394329B1

(12) United States Patent
Magee

(10) Patent No.: US 6,394,329 B1
(45) Date of Patent: May 28, 2002

(54) REMOVABLE BOTTLE HOLDER

(76) Inventor: James M. Magee, 7579 S. Willow Cir., Englewood, CO (US) 80112

( * ) Notice: Subject to any disclaimer, the term of this patent is extended or adjusted under 35 U.S.C. 154(b) by 0 days.

(21) Appl. No.: 09/664,678

(22) Filed: Sep. 19, 2000

Related U.S. Application Data

(60) Provisional application No. 60/162,332, filed on Oct. 29, 1999.

(51) Int. Cl.[7] ..... A45F 5/00

(52) U.S. Cl. ..... 224/678; 224/249; 248/312; 294/87.2

(58) Field of Search ..... 224/249, 251, 224/269, 677, 678, 242, 248; 248/312, 312.1; 294/87.2

(56) References Cited

U.S. PATENT DOCUMENTS

| | | | | | |
|---|---|---|---|---|---|
| 952,107 | A | * | 3/1910 | Furber | 248/312 |
| 1,090,392 | A | * | 3/1914 | Gingras | 248/312 |
| 1,181,942 | A | * | 5/1916 | Underwood | 248/312 |
| 2,161,195 | A | * | 6/1939 | Potts | 248/312 |
| 2,401,578 | A | * | 6/1946 | Miller | 294/87.2 |
| 2,508,945 | A | * | 5/1950 | Heuer | 248/312 |
| 2,637,518 | A | * | 5/1953 | Young | 248/312 |
| 2,753,054 | A | * | 7/1956 | Becher | 248/312 |
| 3,124,285 | A | * | 3/1964 | Castellanos | 224/249 |
| 3,200,536 | A | * | 8/1965 | Petitto, Sr. | 224/312 |
| 3,285,410 | A | * | 11/1966 | Brunsing | 294/87.2 |
| 4,278,225 | A | * | 7/1981 | Phelps | 248/311.3 |
| 5,443,298 | A | * | 8/1995 | Finley et al. | 294/87.2 |
| 6,019,335 | A | * | 2/2000 | Schati | 248/312 |
| 6,131,779 | A | * | 10/2000 | Gendala | 224/148.1 |

* cited by examiner

*Primary Examiner*—Stephen P. Garbe
(74) *Attorney, Agent, or Firm*—Thomas W. Hanson

(57) ABSTRACT

A holder for a water, beverage, or similar container which attaches the container to the user's belt. An upright portion of the holder is designed to be inserted behind the user's belt while a lateral projection supports and retains the container. Two openings in the lateral projection have different sizes: the first allows for easy insertion and removal of the neck, or top, of the container; and the second closely matches the size of the container neck and prevents it from being removed vertically. A reduced sized passage provides for movement of the container between the two openings and is sized to resist this movement, but not prevent it. Alternative embodiments of the holder incorporate devices to retain the holder on the user's belt, and or to retain the bottle within the holder.

20 Claims, 10 Drawing Sheets

REMOVABLE BOTTLE HOLDER

CROSS-REFERENCE TO RELATED APPLICATIONS

This application claims the benefit of U.S. Provisional Application No. 60/162,332 filed Oct. 29, 1999.

FIELD OF THE INVENTION

The present invention relates to the filed of holders for containers and specifically to holders for beverage containers. Even more specifically it relates to such containers intended to be removably attached to the users belt, waistband, or other article of clothing.

BACKGROUND OF THE INVENTION

With growing awareness of the need for people to remain hydrated during exercise, work, or other activity, especially when exposed to high temperatures, has come a need to carry water bottles or other containers. It should be possible to carry the bottle attached to the belt or other article of clothing to free the hands for use in the activity.

Various bottle holders have been developed including sacks or nets with a strap which can be hung around the user's neck and pouches with a belt which can be worn around the waist. These devices are typically cumbersome and relatively expensive.

Where large numbers of people are gathered, it is often necessary to provide water, or other beverages, to these people to avoid dehydration. This is especially true where military operations, search and rescue operations, emergency assistance or aid operations, or similar inject a large number of people into a foreign environment in a relatively short period of time. These circumstances often require the rapid distribution of water to a large number of individuals who will then spread out across a large area. Each person requires their own readily accessible supply of water and may be constantly on the move, needing to carry the water with them. In many such circumstances it can be assumed that the bottle and carrier will likely be discarded or lost rather than being returned, suggesting that the carrier be relatively inexpensive.

There is a need for a holder for a water bottle or similar container which is small, light, unobtrusive, and relatively inexpensive. It should be easy to use, and readily adapt to various methods of attachment to the person, including hooking over a belt and ideally would also adapt to attachment to vehicles, toolboxes, or other items in the users environment.

SUMMARY OF THE INVENTION

The present invention is directed to a water bottle holder which attaches to the users belt and holds the bottle by closely holding the neck of the bottle.

According to the invention there is provided an upright portion intended to be inserted behind the user's belt and a lateral projection which holds the bottle. A larger opening in the projection allows the neck of the bottle to be inserted. The bottle can then be moved laterally to a second opening which is sized to hold the bottle neck at a reduced diameter area to prevent vertical movement of the bottle by being too small to allow passage of the body of the bottle or the flanged portion of the neck near the cap. The passage between the two openings is sized to be slightly smaller than the area of the neck to be held, thus requiring at least a small amount of force to move the bottle between the openings.

According to an aspect of the invention the lateral projection may consist of two or three portions arranged at various angles to each other to enhance the insertion and/or retention of the bottle.

According to another aspect of the invention there may be provided a panel or projection on the outer end of the lateral projection which the user may grip, in combination with the bottle, allowing the user to squeeze them together in order to move the bottle through the passage to the smaller opening.

Further in accordance with the invention there may be a retention loop, made from either a stretchable or relatively rigid material which can be placed over the top of the bottle to hold it in place.

Still further in accordance with the invention, there may be a latch of various designs, which hold the bottle in position within the holder.

The advantages of such an apparatus are a holder which is small, light, easily used and inexpensive to manufacture. It may be distributed in large numbers, requiring little storage space, minimal expenditure, and no instruction as to how it is used, as its operation is readily apparent. It adapts readily to various methods of attachment both to the user and to items in the users environment. An additional benefit is that the inventive holder is relatively independent of the size of the bottle. A given configuration of the holder will retain a variety of bottle sizes as long as they have the same neck size.

The above and other features and advantages of the present invention will become more clear from the detailed description of a specific illustrative embodiment thereof, presented below in conjunction with the accompanying drawings.

DETAILED DESCRIPTION OF THE INVENTION

Figure 1:
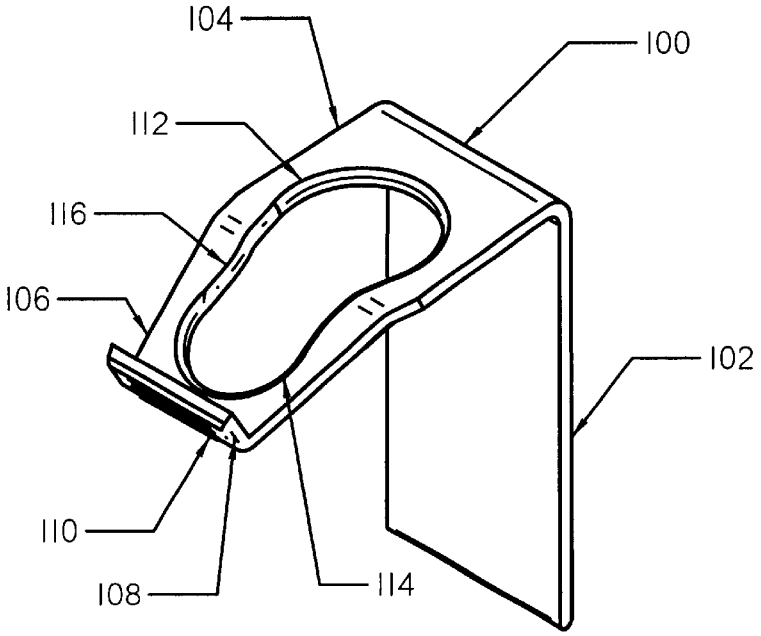
FIG. 1 provides an isometric view of the preferred embodiment.

The following discussion focuses on the preferred embodiment of the invention, water bottle holder for attachment to the user's belt. However, as will be recognized by those skilled in the art, the disclosed apparatus is applicable to a wide variety of situations in which retention of a container of any type having a reduce diameter neck to an article of clothing, vehicle, structure, or other support is desired.

Glossary

The following is a brief glossary of terms used herein. The supplied definitions are applicable throughout this specification and the claims unless the term is clearly used in another manner.

Water bottle—any commercially available container for holding a beverage. While most commonly used with a relatively narrow necked water bottle in which the water is sold, the present invention is applicable to a wide variety of beverage containers, sports bottles, cans, and even to other types of containers whether the contents are fluid or not. The holder is applicable to any container in which the top of the container has a reduced diameter neck portion below a larger portion, as is typical with beverage containers. As used herein, water bottle should be understood to be equivalent to any container to be mounted or retained by the inventive device.

Preferred Embodiment

The disclosed invention is described below with reference to the accompanying Figures in which like reference numbers designate like parts. Generally, numbers in the 200's refer to prior art elements or elements in the surrounding environment while numbers in the 100's refer to elements of the invention.

The present invention, in its various embodiments, is a device for removable retaining a water bottle, or similar beverage container, to a user's belt. The device is also applicable to retaining the container to a vehicle, toolbox, pipe, or any similar structure in the same manner as used with a belt. It is designed to allow the container to be easily inserted and removed with only one hand and to allow the container and device to be removed or installed as a unit. As will be seen below, the invention can be practiced in a variety of embodiments which share a core set of features: an upright portion for hooking behind the user's belt or over another structure; a larger opening through which the top of the bottle is initially inserted; a smaller opening designed to closely receive the neck of the bottle and not allow vertical withdrawal of the bottle; a reduced size passage between the larger and smaller openings sized so as to inhibit, but not prevent, movement of the bottle between the openings; and an optional locking mechanism to positively retain the bottle in place. These features are combined in the various embodiments described below and may also be combined with additional features such as those discussed. The basic structure is readily adaptable to additional, equivalent embodiments.

Structure

The preferred embodiment is illustrated in FIGS. 1, and 3–5, and illustrated in use in FIGS. 2 and 6–8. The inventive holder, 100, is designed so that the vertical panel, 102, can be inserted behind a belt, 202, or in the waistband of a pair of pants. It is slid down until panel, 104, is supported by the top of the belt or pants. Panel, 104, preferably angles downward slightly and connects to panel, 106, which angles more steeply downward. This provides for easy insertion through the first panel while the second panel holds the bottle at a slight angle back towards the user's hip for improved retention and stability. Panel, 102, or the user's hip would typically contact the side of the bottle, pushing it outward. This force urges the bottom of the bottle outward, imparting an angular biasing force on the bottle, tightening it within the retaining opening, 114.

The insertion opening, 112, is sized to freely receive the neck of the bottle, 200, including enlarged ridge, 204, as the bottle is inserted with a substantially vertical motion. With the ridge positioned above the upper surface of the holder (easily achieved by moving the bottle upward as far as the holder will allow) the bottle is then moved outward through the reduced passage, 116, to the retaining opening, 114. The retaining opening is sized to closely receive the portion of the bottle neck immediately below the enlarged ridge, preventing downward movement. It should be noted that the holder could also engage the cap of the bottle rather than the ridge. The reduced passage is sized to be somewhat smaller than this same portion of the bottle neck. Passage of the bottle neck is achieve by either the outward flexing of the walls of the passage or a slight compression of the neck. It thus requires a small, but definite, amount of force to move the bottle between the openings. This assists the retention of the bottle in the holder by preventing the bottle from moving freely back to the insertion opening. It should be noted that while the illustrated embodiments incorporate round openings to match the typical beverage bottles, these openings can be any shape which lends itself to use with the container for which is intended to be used. It should also be noted that the reduced passage may be formed as the intersection of the two openings rather than as a distinct opening.

Movement of the bottle outward to the retaining opening can be achieved by pushing outward on the bottle, but is preferably achieved by grasping the bottle and holder with one hand with the thumb on the inner side of the bottle neck and the fingers in the outer surface of gripping portion, 108, and squeezing to force the bottle and outer end of the holder towards each other. Ridges, 110, provide increased friction to the users fingers when using this method. Clearly other friction enhancing structures such as raised dots, depressed dimples, or even an add on high friction compound or tape could also be used. Alternatively, the vertical panel could be eliminated and the user could grasp the end of panel, 106.

Optional ribs, 118, served to strengthen and stiffen the structure alongside the openings, 112 and 114, and passage, 116, where there is a relatively small amount of material. Depending on the material from which the holder is constructed and the thickness of the panels, 104 and 106, the ribs may or may not be necessary.

The design of the holder lends itself to a variety of materials and manufacturing methods. Various plastics perform well and may be injection molded, thermal formed, and stamped. Metals, such as aluminum and steel, are also satisfactory. While generally more expensive, metals offer increased strength and wear as may be required for use in more rigorous activities or for military applications. Stamping would be a typical method of forming the holder from metal, but clearly other techniques such as machining or casting could be used as desired. As discussed below, the inventive holder can also be formed by bending wire, rod or bar of various cross sectional shapes to achieved the same general shape.

Operation

Figure 2:
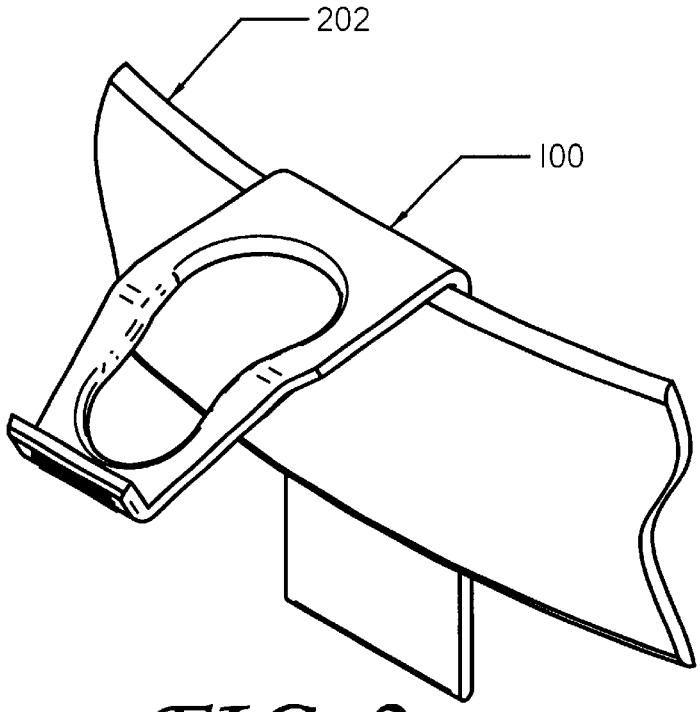
FIG. 2 illustrates the preferred embodiment in position on a user's belt.
Figure 3:
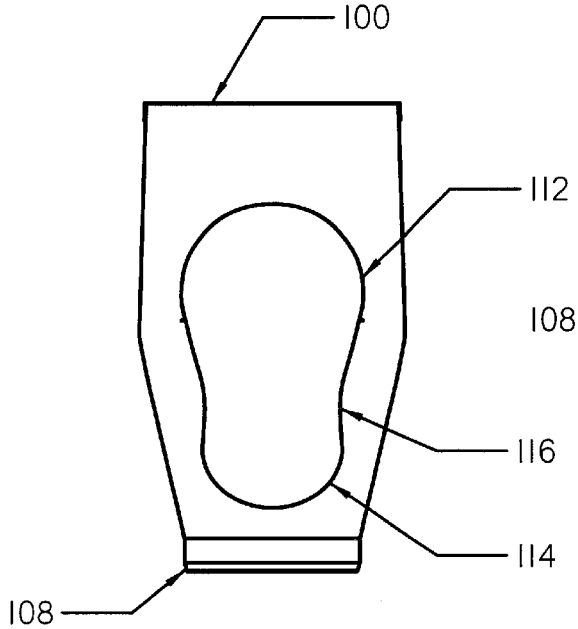
FIG. 3 is a top view of the preferred embodiment.
Figure 4:
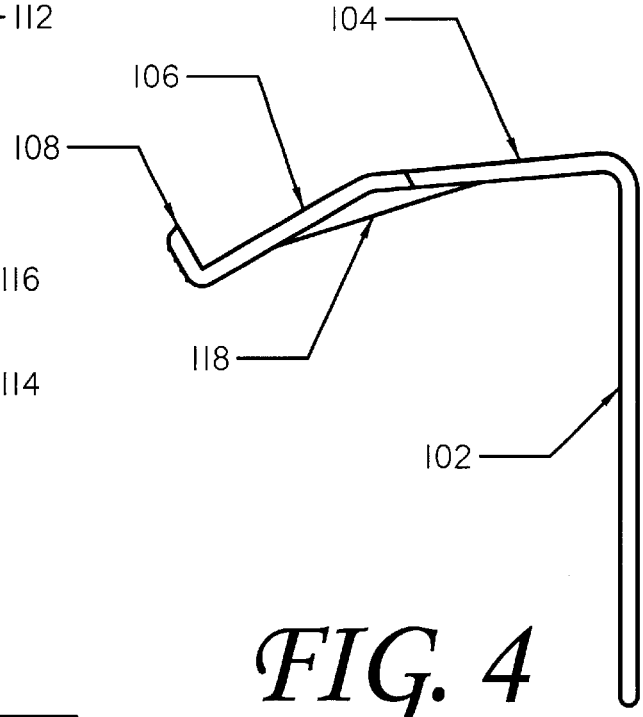
FIG. 4 is a side view of the preferred embodiment.
Figure 5:
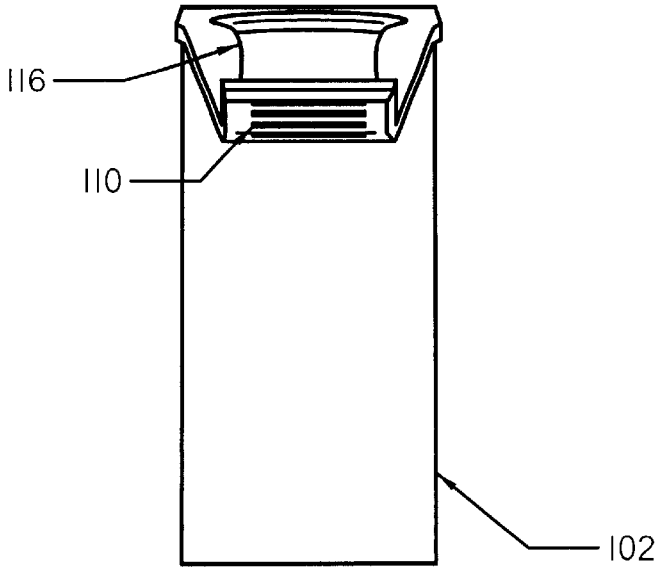
FIG. 5 is a front view of the preferred embodiment.
Figure 6:
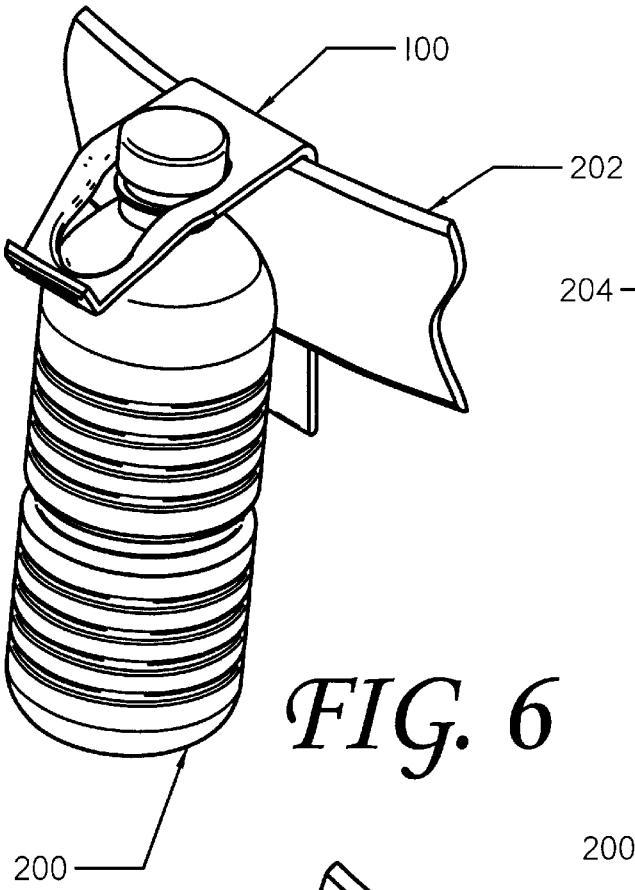
FIG. 6 illustrates a typical water bottle partially inserted in the holder.
Figure 7:
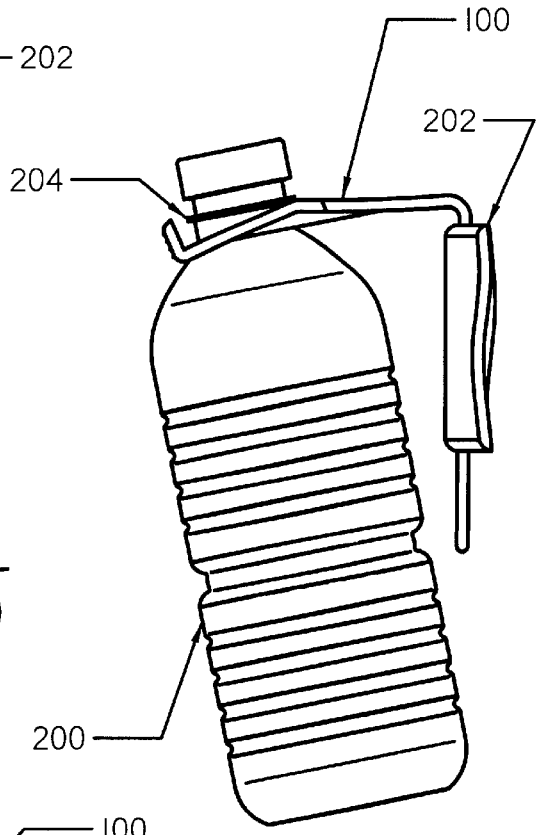
FIG. 7 is a side view of the bottle fully inserted in the holder.
Figure 8:
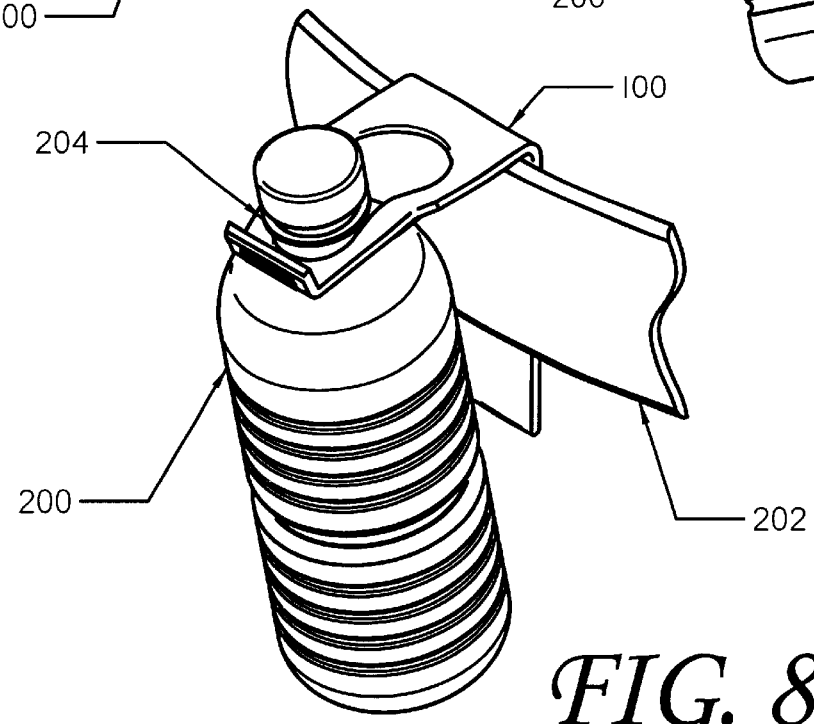
FIG. 8 is an isometric view of the bottle fully inserted in the holder.

In use, the holder will generally be inserted behind the user's belt or in their waistband, see FIG. 2; the bottle inserted vertically from below, see FIG. 6; and the bottle snapped outward into position, see FIGS. 7 and 8. Alternatively, the holder may first be attached to the bottle and then the bottle and holder, as a unit, attached to the belt or clothing of the user. This method would be attractive where large numbers of water bottle and holders are being distributed. This might occur where water is being supplied to search and rescue teams, aid workers, or military personnel. This approach can also be used when the bottle is being attached to an item other than the user's belt or pants. The holder is equally applicable to clip a bottle to a toolbox, vehicle, structural member, or any other convenient item in the user's environment.

The holder is also applicable to the retention of other types of containers. Solvents, cleaning fluids, lubricants, etc. can be kept readily accessible to workers by using the holder to attach their containers to nearby racks, benches, or other items.

Alternative Embodiments

Figure 9:
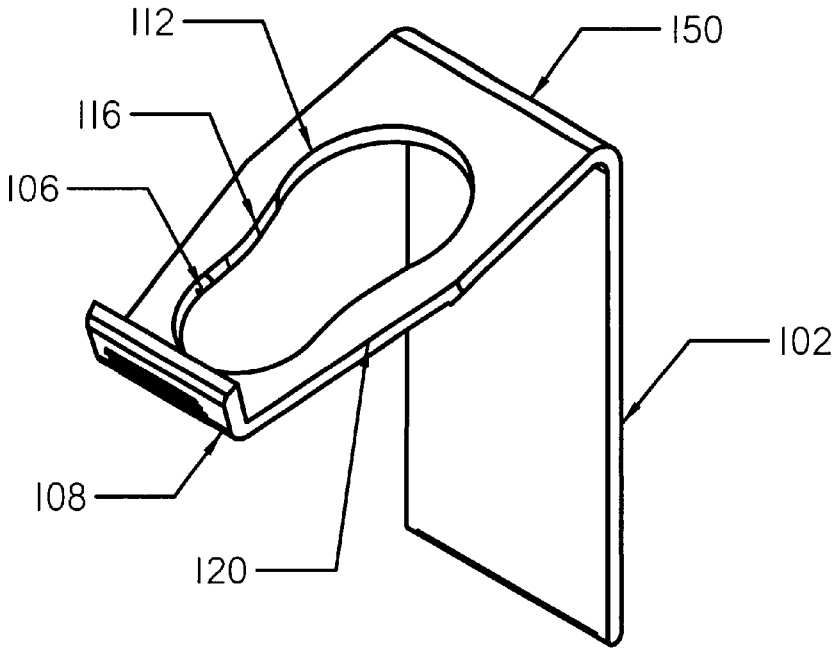
FIG. 9 illustrates an alternative embodiment with a single angle in the lateral projection.

The basic design of the holder is readily adapted to a variety of alternative embodiments. The embodiment, 150, of FIG. 9, uses a single angled panel, 120, in place of separately angled panels, 104 and 106, of the preferred embodiment. Somewhat simpler to manufacture, it is also has somewhat reduced performance in terms of insertion and retention of the bottle.

Figure 10:
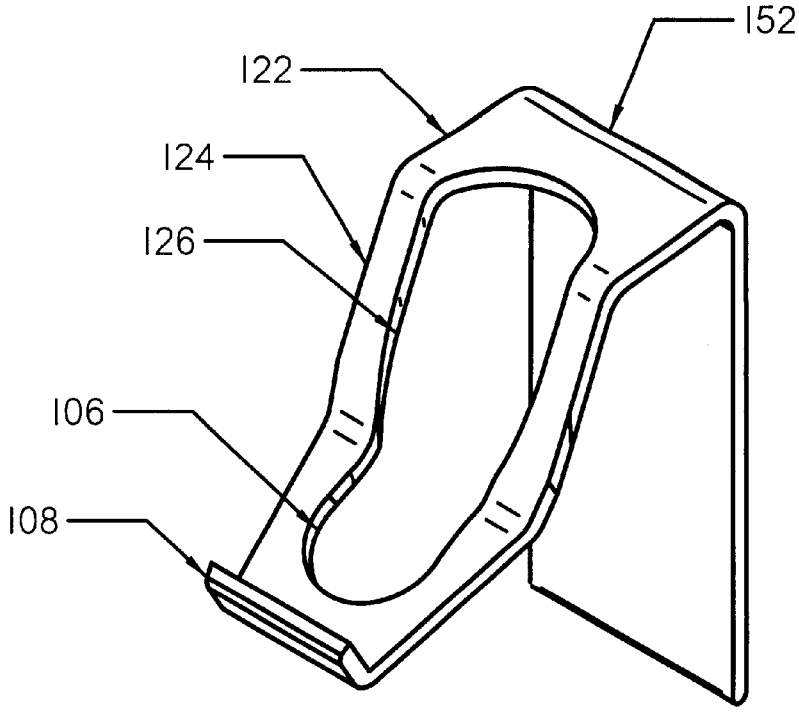
FIG. 10 illustrates an alternative embodiment with three separately angled portions to the lateral projection.

FIG. 10 illustrates an embodiment, 152, in which three steps, or panels, are used, 122, 124, and the original 106. Opening, 126, corresponds to the insertion opening, 112, of the preferred embodiment, but has been enlarged and includes an elongated, steeply angled portion which spans panel, 124. This configuration allows the bottle to be inserted laterally with a single outward motion, rather than the combined vertical and lateral movement required with the preferred embodiment.

Figure 11:
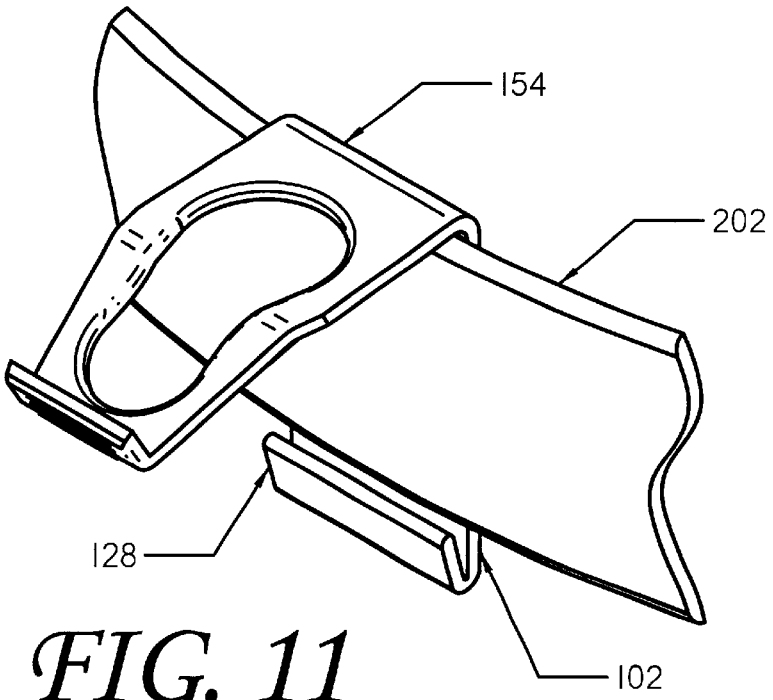
FIG. 11 illustrates an alternative embodiment with a hook to retain the holder in position.
Figure 12:
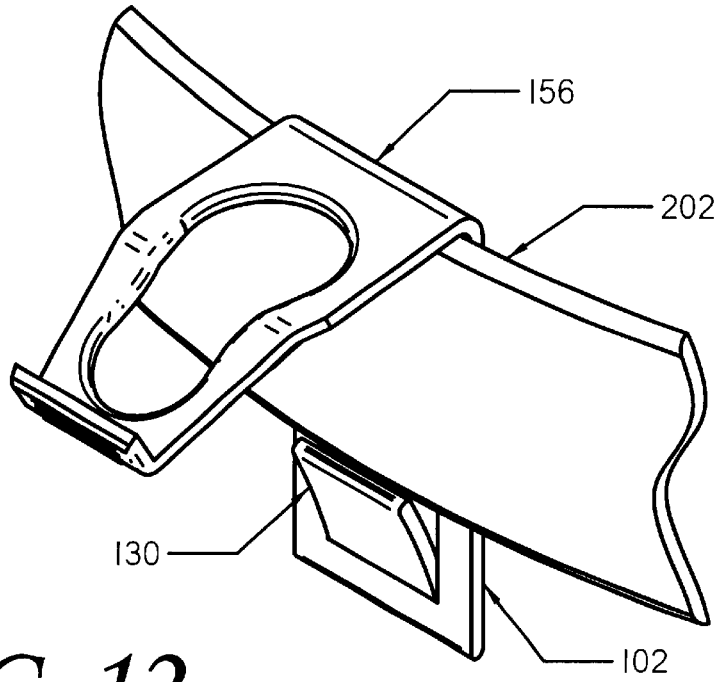
FIG. 12 illustrates an alternative embodiment with a clip to retain the holder in position.

Embodiment 154, FIG. 11, differs from the preferred embodiment by the addition of projection, or hook, 128, to the end of panel, 102. This hook is designed to extend outward below the user's belt, 202, and to catch on the belt when the holder moves upward. This helps retain the holder on the belt during vigorous activities, such as running or climbing, or when there is a risk that the holder or bottle may become snagged on an obstruction. This hook could be formed at any desired angle, including perpendicular. The projection may also serve to bear against the side of the bottle more firmly than would the straight configuration, improving retention. Similarly, embodiment, 156, FIG. 12, provides a clip, 130, formed in the body of panel, 102. It functions in a similar manner, but offers more flexibility in the clip which may be compressed slightly to reduce the cross section. It also may bear on the water bottle, urging it outward, improving retention. If desired, retention can be further improved by adding ridges, dimples, or other grip improving structures to the face of panel, 102, which contacts the user's belt, and/or on the opposite face.

Figure 13:
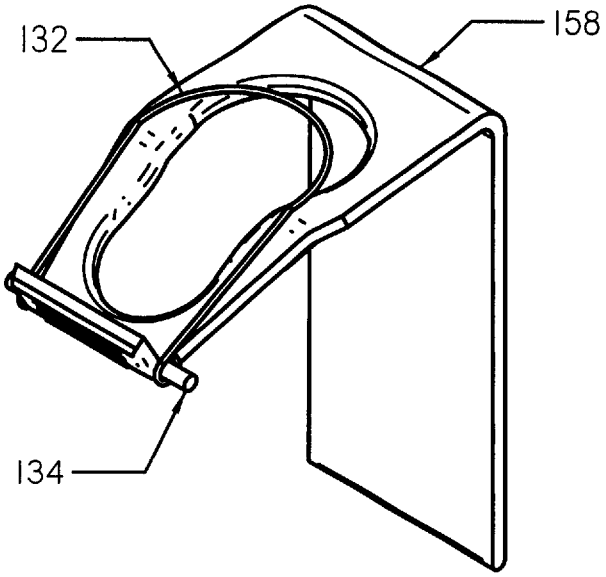
FIG. 13 illustrates an alternative embodiment with a loop pivoting on pins to retain the bottle in the holder.
Figure 14:
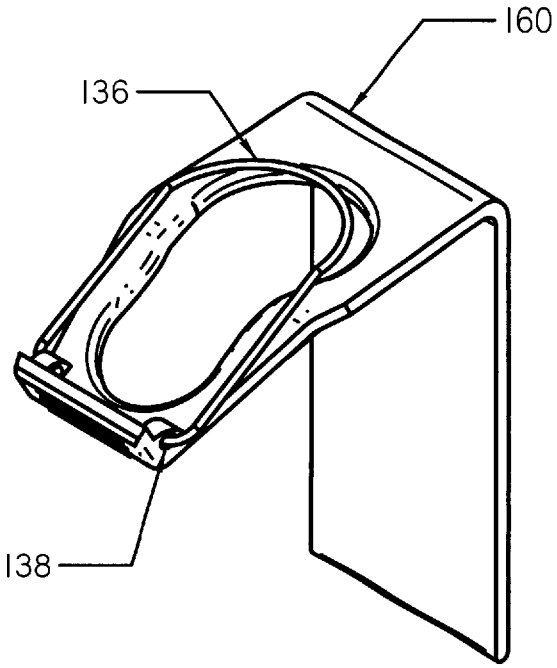
FIG. 14 illustrates an alternative embodiment with a loop pivoting in holes to retain the bottle in the holder.

Embodiments, 158 and 160, FIGS. 13 and 14, seek to improve retention of the bottle by physically preventing its movement toward the insertion opening, where it could fall out. Both utilize a retention loop formed of any suitable material which can be placed over the top of the bottle, substantially fixing the bottle in position. Loop 132 is retained to the holder by positioning rings over pins, 134, formed in the holder. Optional clips or locks can be used on the ends of the pins to help retain the loop. Loop 136 is retained by inserting the ends of the loop into holes, 138, formed in the holder. Both configurations allow the loop to pivot freely through a constrained arc for positioning. If desired, the loop may be manufactured of a stretchable material, such as rubber, whereby it can apply a positive outward force to the bottle. Also if desired a latch can be incorporated into the loop to hold it closed. One form would be to form protrusions on the side of the loop which engage the sides of the passage or insertion opening when the loop is rotated to the down, or closed, position.

Figure 15:
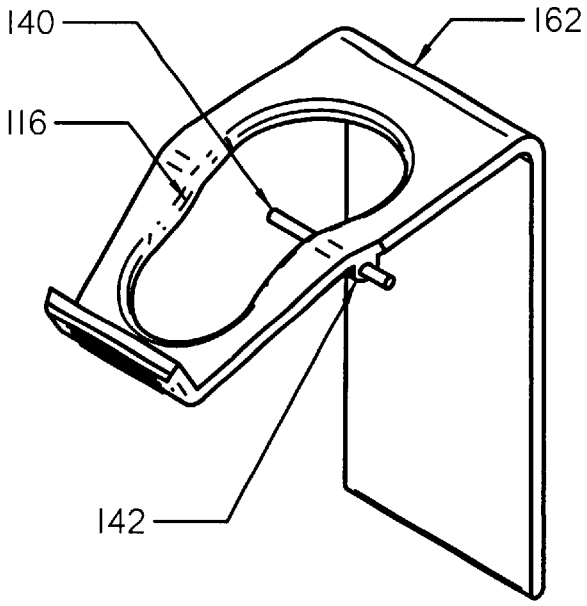
FIG. 15 illustrates an alternative embodiment with a sliding pin latch.

Embodiment, 162, FIG. 15, approaches the bottle retention task by using pin, 140, which is slidably retained by hole, 142. Sufficient lateral movement is allowed that the pin may be fully withdrawn from the opening, allowing the bottle to move. When fully inserted, the pin blocks all or part of the passage, 116, blocking movement of the bottle. The pin may be positioned on either side or even on both sides of the opening. If desired the pin can be spring biased into the closed position. As a further alternative, the pins may be threaded or otherwise adjustable in terms of the distance they intrude into the neck. By adjusting the intrusion of the pins, an adjustable size neck, for accommodating different sizes of bottles, is achieved.

Figure 16:
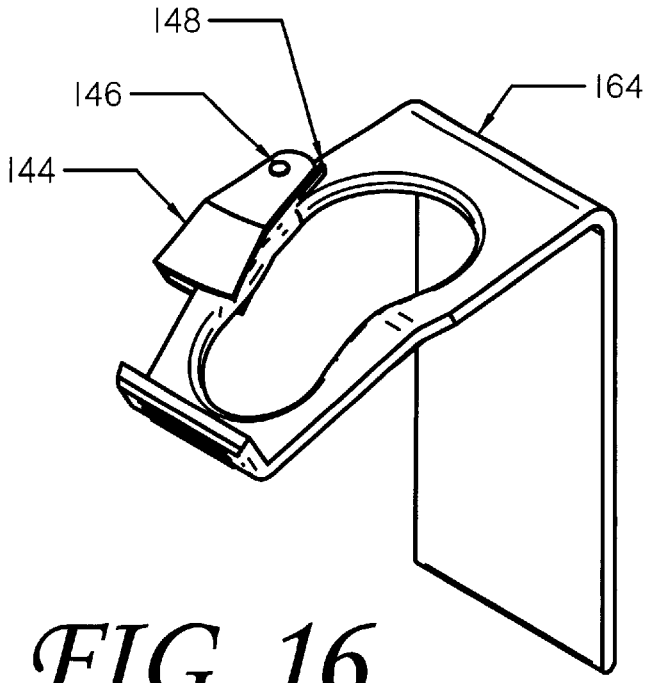
FIG. 16 illustrates an alternative embodiment with a sideways pivoting latch.
Figure 17:
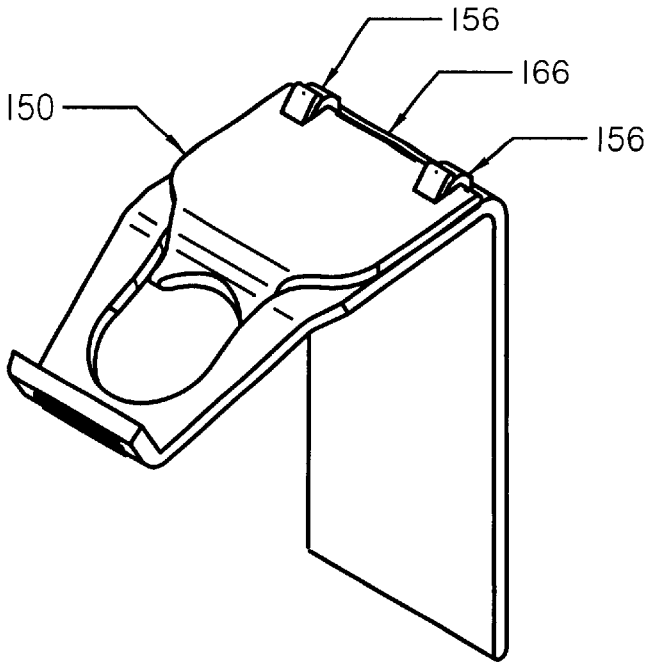
FIG. 17 illustrates an alternative embodiment with a vertically pivoting latch, with the latch closed.
Figure 18:
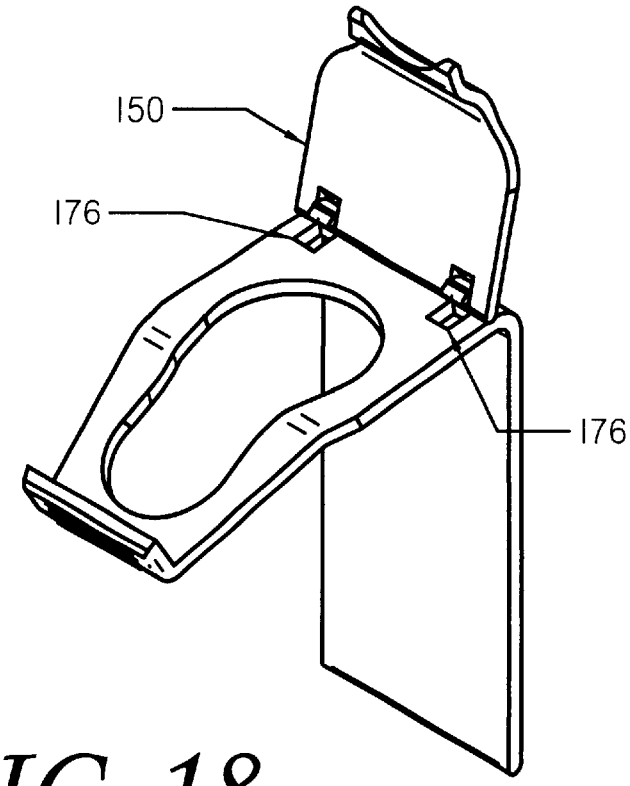
FIG. 18 illustrates an alternative embodiment with a vertically pivoting latch, with the latch open.
Figure 19:
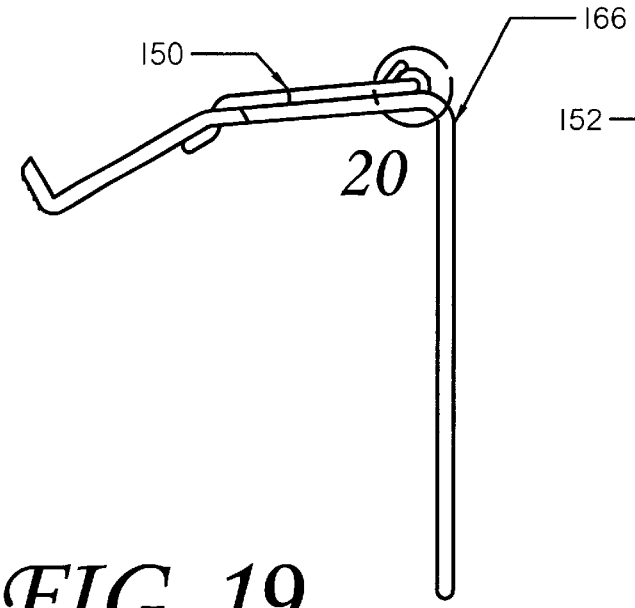
FIG. 19 is a side view of the alternative embodiment of FIG. 17, illustrating the closed position.
Figure 20:
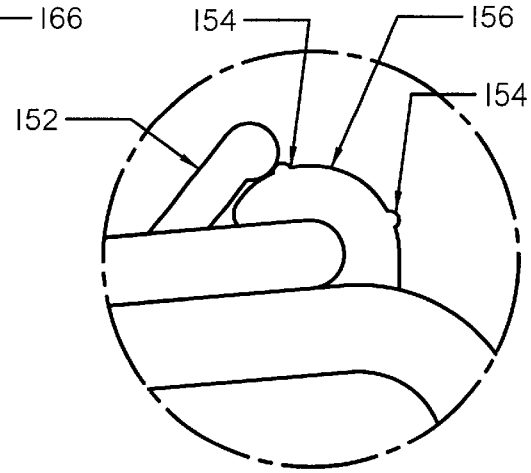
FIG. 20 is a detailed view of the catch in the closed position.
Figure 21:
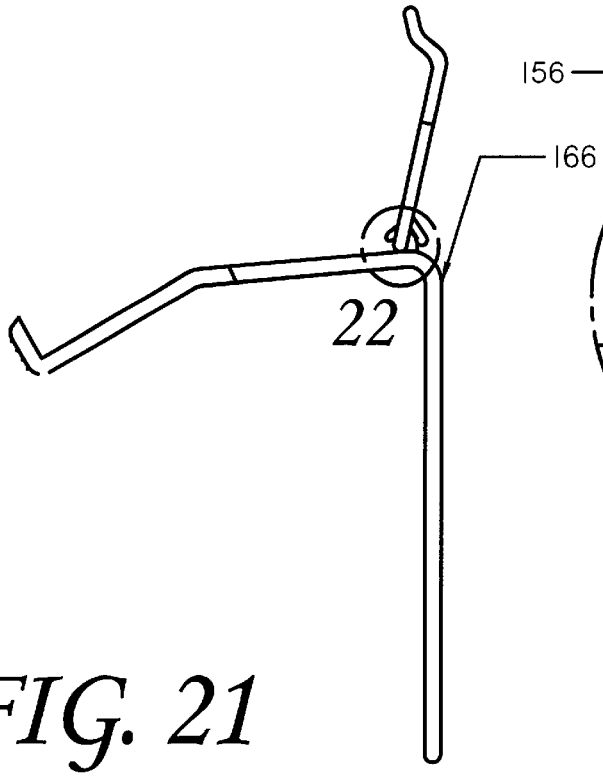
FIG. 21 is a side view of the alternative embodiment of FIG. 17, illustrating the closed position.
Figure 22:
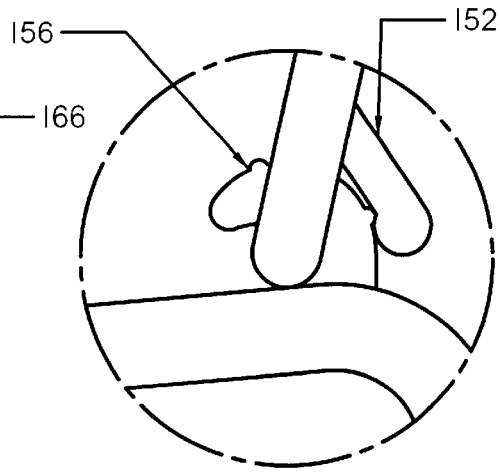
FIG. 22 is a detailed view of the catch in the open position.

FIG. 16 illustrates embodiment, 164, which incorporates pivoting latch, 144. Pin, 148, provides a pivot about which the latch rotates though a small arc. When the latch is moved outward, the bottle is free to move through the passage. With the latch moved inward, the passage is at least partially blocked prevent removal of the bottle. The latch may have members both above and below the panels, as shown, or on only one side. Protruding bumps or ridges on the surface of the latch toward the panel can be used to hold the latch in the open and/or closed position. Alternatively, a spring or other resilient means may be used to urge the latch into the closed position. This would allow the latch to move aside as the bottle is inserted, but stay in position (due to the sharp angle of the face toward the bottle) if the bottle moves inward. The latch would have to be manually moved aside to release the bottle. Optional stop, 148, prevent excessive inward movement of the latch in either form.

FIGS. 17–22 illustrate an alternative embodiment which utilizes a pivoting top latch, 150, to secure the bottle. The latch is retained by hinges, 156, which allows the latch to pivot through a range somewhat greater than 90 degrees. In the closed position, FIGS. 17, 19 and 20, the latch completely blocks off the insertion opening and retains the neck of the bottle in the retaining opening. In the open position, FIGS. 18, 21, and 22, the latch swings out of the way allowing the bottle to be inserted and removed as usual. Optional catch, 152, and ridges, 154, serve to hold the latch in either the closed or open positions. An alternative catch mechanism would be to provide at least one finger which extends into one or both of openings, 176, and engages the edge of the opening when the latch in is the down position. As an option, a compass, watch, or another device can be mounted to the top surface of the latch where it is readily available to the user.

Figure 23:
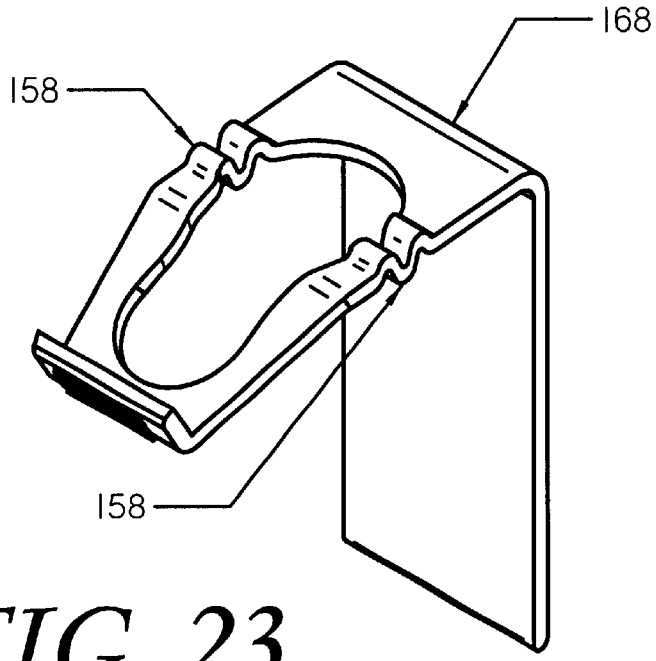
FIG. 23 illustrates an alternative embodiment with accordion pleats for flexibility.

Illustrated in FIG. 23 are optional accordion pleats, 158, which may be added to the frame at any desired location. The pleats serve to make the frame more flexible without compromising strength.

A further alternative is to provide a hinge at the joint of panel, 102, and panel, 104, to allow the retained bottle to be freely pivoted away from the user's body. If desired, a travel stop could be included to limit the downward travel at any point, such as that approximating the position of the preferred embodiment.

Another alternative is use a removable plug, or similar, to block off the insertion opening rather than a pivoting latch. This could be a rubber plug, rigid plate, or even a tube which also holds items such as matches, which sufficiently occupies the insertion opening that the bottle is retained substantially in position. Preferably, this plug would be attached to the holder by a tether to prevent loss.

Figure 24:
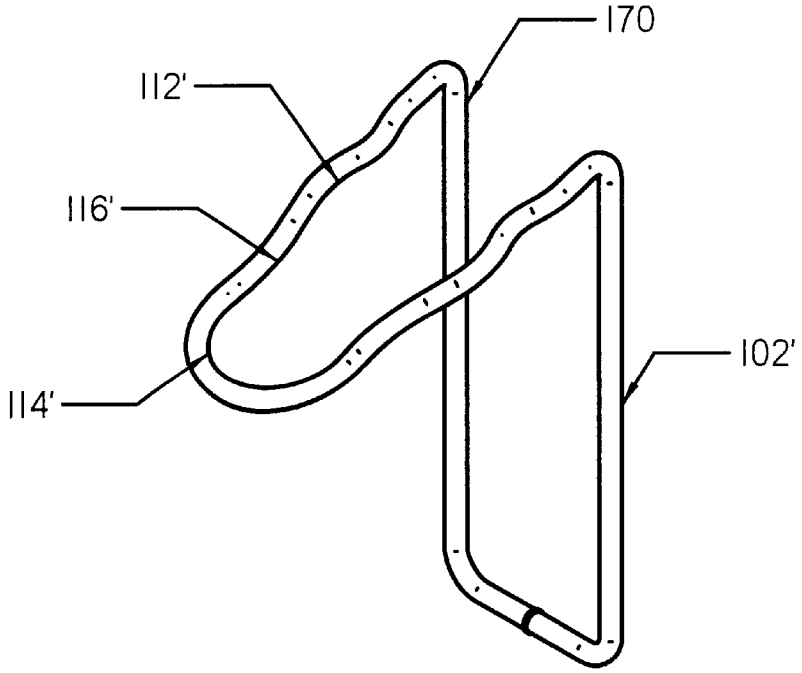
FIG. 24 illustrates an alternative embodiment formed from wire or rod.

As FIG. 24 illustrates, the inventive holder can also be manufactured by forming wire, rod, or bar into the same shape. While somewhat different in appearance, this embodiment, 170, incorporates the vertical panel, 102'; insertion opening, 112'; reduced passage, 116'; and retaining opening, 114'; as discussed above. As illustrated, the simplified version of embodiment 150 has been formed, with the vertical portion, 108, eliminated. Clearly, any of the above embodiments could be created through the same process. If desired a panel or sleeve can be added to panel 102' for increased support and to resist the spreading apart of the wires.

Clearly, the features of the various alternative embodiments can be combined as desired.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. A removable holder to attach a container to a support, the container having a top and a reduced diameter neck portion, said removable holder comprising:

(a) an upright portion adapted for insertion behind the belt;

(b) a lateral projection, attached to and extending outward from said upright portion, defining:

(i) an insertion opening adapted to freely receive the top of the container;

(ii) a retaining opening adapted to closely receive the reduced diameter neck portion of the container, said retaining opening having a width; and (iii) a reduced passage, communicating between said insertion opening and said retaining opening, said passage having a width at least somewhat smaller than said retaining opening width.

2. The removable holder of claim 1 wherein said lateral projection comprises first and second portions connected at a slight angle relative to each other.

3. The removable holder of claim 2 wherein said insertion opening is defined at least partially in said first portion and said retaining opening is defined at least partially in said second portion.

4. The removable holder of claim 1 wherein said lateral projection has a distal end and said holder further comprises a gripping projection extending at a substantial angle from said distal end.

5. The removable holder of claim 4 wherein said gripping projection comprises a friction enhancing structure.

6. The removable holder of claim 1 further comprising a retention projection attached to and projecting from said upright portion and adapted to engage the belt.

7. The removable holder of claim 1 further comprising a retention loop pivotally attached to said lateral projection and adapted to engage the container, preventing it from moving into said insertion opening.

8. The removable holder of claim 7 wherein said retention loop comprises a resilient portion adapted to urge the container in the direction from said insertion opening toward said retaining opening.

9. The removable holder of claim 1 further comprising a retention latch attached to said lateral projection and movable between a first position which allows movement of the container between said retaining opening and said insertion opening, and a second position which blocks said movement.

10. The removable holder of claim 9 wherein said latch is slidably attached to said lateral projection.

11. The removable holder of claim 9 wherein said latch is rotatably attached to said lateral projection.

12. The removable holder of claim 11 wherein said latch rotates in a plane substantially parallel to the plane of said lateral projection.

13. The removable holder of claim 11 wherein said latch rotates in a plane substantially perpendicular to the plane of said lateral projection.

14. The removable holder of claim 11 wherein said latch comprises a catch to releasably retain said latch in at least one of said first and second positions.

15. The removable holder of claim 1 wherein said lateral projection comprises at least one accordion fold portion adapted to provide increased flexibility to said projection.

16. The removable holder of claim 1 wherein said lateral projection comprises first, second, and third portions wherein said second portion interconnects said first and third portions and is positioned at a substantial angle relative to both of said first and third portions and said insertion opening is defined at least partially in said first portion and second portions, and said retaining opening is defined at least partially in said third portion whereby the container can be inserted into said insertion opening in a substantially lateral direction.

17. A removable holder to attach a container to a support, the container having a top and a reduced diameter neck portion, said removable holder comprising:

(a) an upright portion adapted for insertion behind the belt;

(b) a lateral projection, attached to and extending outward from said upright portion, having first and second portions connected at a slight angle relative to each other, and having a distal end, said lateral projection defining:

(i) an insertion opening adapted to freely receive the top of the container, defined at least partially in said first portion;

(ii) a retaining opening adapted to closely receive the reduced diameter neck portion of the container, said retaining opening having a width and being defined at least partially in said second portion; and (iii) a reduced passage, communicating between said insertion opening and said retaining opening, said passage having a width at least somewhat smaller than said retaining opening width; and (c) a gripping projection extending at a substantial angle from said distal end.

18. The removable holder of claim 17 further comprising means for retaining said holder substantially in position relative to the belt.

19. The removable holder of claim 17 further comprising means for retaining the container substantially within said retaining opening.

20. The removable holder of claim 19 wherein said means for retaining comprises a latch movable between a first position which allows movement of the container out of said retaining opening, and a second position which blocks said movement.

* * * * *